US006633240B1

(12) United States Patent
Sweatt

(10) Patent No.: US 6,633,240 B1
(45) Date of Patent: Oct. 14, 2003

(54) EMERGENCY WARNING SYSTEM

(76) Inventor: Larry G. Sweatt, P.O. Box 4141, Wichita Falls, TX (US) 76308

( * ) Notice: Subject to any disclaimer, the term of this patent is extended or adjusted under 35 U.S.C. 154(b) by 0 days.

(21) Appl. No.: 10/103,899

(22) Filed: Mar. 25, 2002

(51) Int. Cl.[7] ..... G08G 1/123
(52) U.S. Cl. ..... 340/995.1; 340/601; 340/539.26
(58) Field of Search ..... 340/995.1, 506, 340/904, 996, 540, 539.1, 539.11, 539.13, 539.2, 539.22, 539.16, 539.17, 539.26–539.32, 601

(56) References Cited

U.S. PATENT DOCUMENTS 6,288,639 B1 * 9/2001 Addy ..... 340/539
6,369,705 B1 * 4/2002 Kennedy ..... 340/506
6,462,665 B1 * 10/2002 Tarlton et al. ..... 340/601
6,469,641 B1 * 10/2002 Lash et al. ..... 340/984

* cited by examiner

*Primary Examiner*—Nina Tong
(74) *Attorney, Agent, or Firm*—Stephen R. Greiner

(57) ABSTRACT

An emergency warning system including a sensor for detecting an environmental condition. A first transmitter is connected to the sensor for broadcasting a communication signal carrying information describing the environmental condition. A first receiver receives the communication signal from the first transmitter. A second transmitter is connected to the first receiver for broadcasting an alert signal carrying information describing the environmental condition. A second receiver receives the alert signal from the second transmitter and has an indicator for exhibiting the information indicative of the environmental condition.

11 Claims, 1 Drawing Sheet

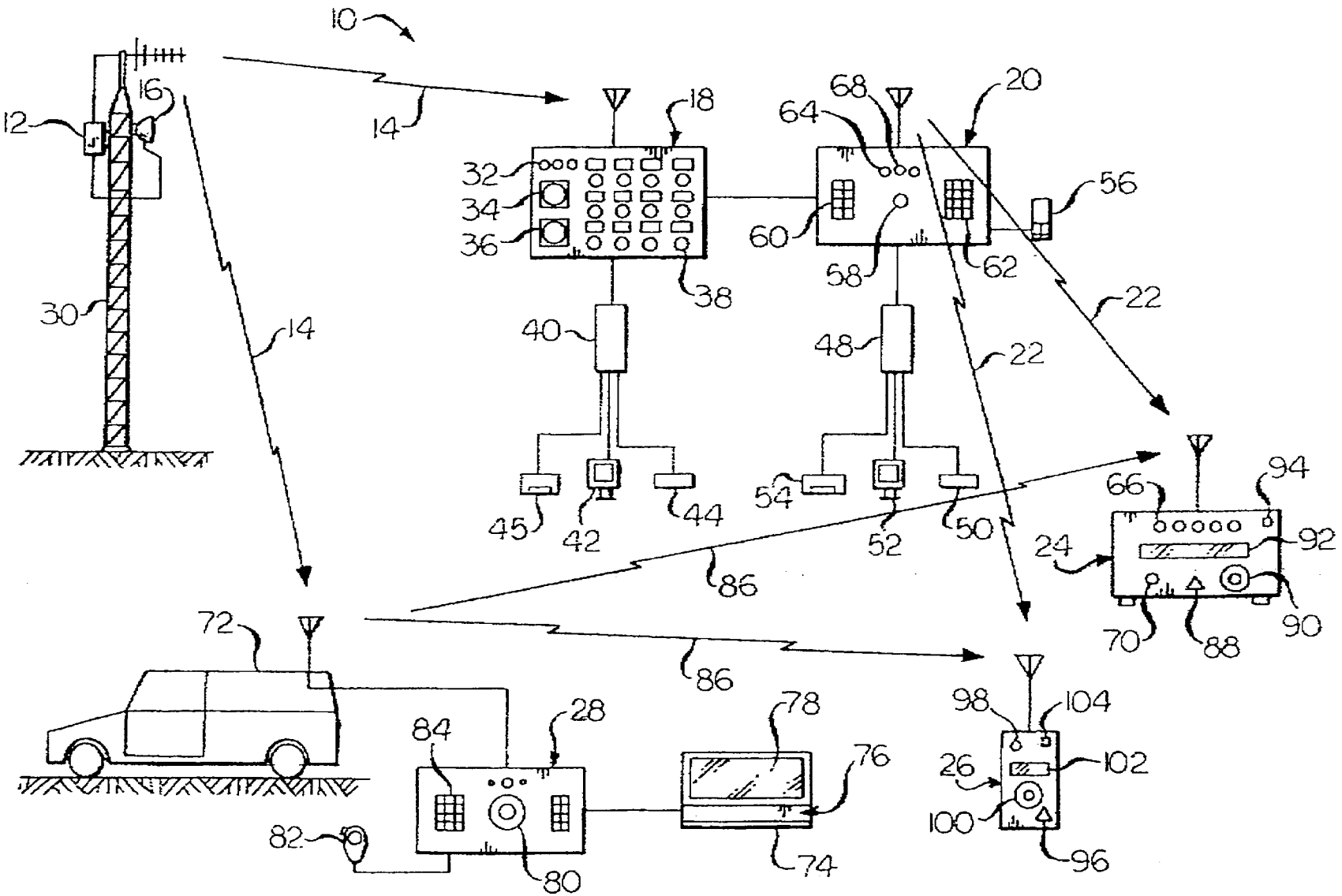
10
12
14
16
18
20
22
24
26
28
30
32
34
36
38
40
42
44
45
48
50
52
54
56
58
60
62
64
66
68
70
72
74
76
78
80
82
84
86
88
90
92
94
96
98
100
102
104

EMERGENCY WARNING SYSTEM

FIELD OF THE INVENTION

The present invention relates generally to electrical communications systems and, more particularly, to condition responsive indicating systems with particular safety functions.

BACKGROUND OF THE INVENTION

As society has moved into the 21st Century, some of its disaffected members have resorted to acts of extreme violence and terror as a way of being heard. Some of these acts have taken the lives of thousands of people and have injured thousands more. Unfortunately, no one foresees an end to acts such as these. At this point in time, one can only hope to be forewarned a reasonable period of time in advance of such an act so that precautions can be taken to altogether avoid or minimize the expected harm.

To a certain extent, mass media—radio and, television in particular—is effective in rapidly alerting the public of impending, ongoing and completed acts of terrorism. The principal drawback of relying principally upon radio and television to provide alerts of terrorist activities is that the alerts cannot be transmitted to receivers that are turned off. Of course, most users do not keep their radios and televisions turned on at all times, and broadcasters lack the ability to energize conventional radios and televisions. Thus, it can be expected that many would miss critical broadcast alerts about impending and ongoing terrorist activities and would be harmed as a result.

SUMMARY OF THE INVENTION

In light of the drawbacks associated with using broadcast media to rapidly and accurately disseminate information important to public health and welfare, it is a principal object of the invention to provide an emergency warning system that could be used only by authorized personnel to notify specified people of impending dangers. These dangers might include: fires, explosions, chemical spills, hostage takings, radiation leaks, and the spread of biological agents or gasses to name a few. Apart from news regarding dangers, time-critical information related to weather and earth movements can be delivered to interested parties by modified forms of the system.

It is a further object of the invention to provide an emergency warning system of the type described that can be employed to provide time-critical information wherever they may be located, whether at home, at work, in a vehicle, or otherwise.

It is another object of the invention to provide an emergency warning system of the type described that alerts users of its activation with audible and visual alarms. Once the alarms have sounded, detailed information may be obtained in a visual and audible manner. Message transmission can be selectively terminated by a user.

It is an object of the invention to provide improved elements and arrangements thereof in an emergency warning system for the purposes described that is rugged in construction, inexpensive to manufacture, and dependable in use.

Briefly, the emergency warning system in accordance with this invention achieves the intended objects by featuring a transmitter for broadcasting a radio frequency (RF) communication signal carrying information produced by a sensor to a receiver. The receiver is connected to another transmitter so as to permit the broadcast an RF alert signal carrying public warnings as required by the content of the communication signal to a desktop receiver or a pocket pager. Upon detecting the alert signal, the desktop receiver and the pager issue audible and visual alarms.

The foregoing and other objects, features and advantages of the present invention will become readily apparent upon further review of the following detailed description of the preferred embodiment as illustrated in the accompanying drawings.

BRIEF DESCRIPTION OF THE DRAWING

The present invention may be more readily described with reference to the accompanying drawing which is a schematic diagram of an emergency warning system in accordance with the present invention.

DETAILED DESCRIPTION OF THE PREFERRED EMBODIMENT

Referring now to the accompanying drawing, an emergency warning system in accordance with the present invention is shown at 10. System 10 includes a transmitter 12 for broadcasting a radio frequency (RF) communication signal 14 carrying information produced by a sensor 16 to a receiver 18. Receiver 18 is connected to another transmitter 20 in such a manner as to permit the broadcast an RF alert signal 22 carrying public warnings as required by the content of communication signal 14 to a desktop receiver 24 or a pocket pager 26. Upon detecting alert signal 22, receiver 24 and pager 26 issue audible and visual alarms. A mobile transceiver 28 serves as a backup to transmitter 20.

Sensor 16 is mounted on a tower 30 in a predetermined geographical area. Sensor 16 detects airborne particulate matter immediately harmful to humans and produces a unique electrical detection signal in response. Preferably, sensor 16 is capable of identifying a select disease-causing microbe, poisonous gas or radioactive compound. Sensor 16, however, may be a seismograph or weather-monitoring instrument. Sensors of the sort described are commercially available from a variety of sources.

Tower 30 carries a transmitter 12 connected to sensor 16. Transmitter 12 receives a detection signal from sensor 16 after such has identified harmful matter and, in response, broadcasts a unique, RF communication signal 14 to receiver 18 in a secure location under the control of community leaders. Communication signal 14 carries information regarding the location of transmitter 12 and the type and, perhaps, concentration of the harmful matter detected by sensor 16. Of course, if sensor 16 is a seismograph or weather gauge, the pertinent information regarding: earth tremors, temperature, rainfall, etc., would be encoded by transmitter 12 and carried by communication signal 14 to receiver 18.

Transmitter 12 and receiver 18 are connected together through conventional telephone communications lines (not shown). Should transmitter 12 be unable to establish a RF communications link with receiver 18, the telephone lines permit transmission of the communication signal to receiver 18. Thus, system 10 is provided with a backup connection between transmitter 12 and receiver 18 making the connection failsafe.

Receiver 18 can detect and process communications signals from secondary sources. Such secondary sources might include the National Oceanic and Atmospheric Administration (NOAA) having ground-based and earth-orbiting weather sensors: Additionally, the new Office of Homeland Security has an intelligence-gathering network yielding terror forecasts that could be broadcast to receiver 18. These forecasts may be accompanied by a color-coded warning to indicate the immediate likelihood of an act of terror.

Upon receipt of a communications signal by receiver. 18, it acts to energize both a visible indicator light 32 and an audible alarm 34. Further, receiver 18 causes a message to be produced on an LCD display 36 that summarizes the data received from sensor 16. That data might include an indication that deadly *C. botulinum* microbes or abnormally high radiation levels were detected. A reset button 38 on receiver 18 permits an operator to deenergize light 32 and alarm 34 and clear LCD display 36.

Receiver 18 is connected to a computer processor 40 within which is stored a map of the geographical area where tower 30 are positioned. Processor 40 is connected to a monitor 42 that displays the stored map along with the position of tower 30 and the substance of any communications signals 14 from sensor 16. For manipulating the images exhibited by monitor 42, processor 40 is connected to a keyboard 44 into which image-manipulating commands may be types. A printout of an image exhibited by monitor 42 may be obtained from a printer 45 also connected to processor 40.

Receiver 18 is connected to stationary transmitter 20 for alerting the public of any dangerous conditions detected by sensor 16. Transmitter 20 is in the possession of an authority responsible for emergency preparedness for the geographical area having tower 30. Transmitter 20 is connected to a computer processor 48 for the development of written messages for broadcast to desktop receivers 24 and pagers 26 via transmitter 20. Processor 48 is connected to a keyboard 50 and an associated monitor 52 for viewing the written messages during their entry into processor 48. A printer 54, connected to processor 48, permits a permanent record of all written messages to be made. Additionally, a microphone 56 is connected to transmitter 20 for entering verbal messages into transmitter 20. To ensure that authorized personnel only enter of written and verbal messages into transmitter 20, transmitter 20 is provided with a lockout circuit (not shown), capable of being closed only with a key or combination, which normally disconnects keyboard 50 and microphone 56 from transmitter 20.

To use transmitter 20, an operator closes the lockout circuit so as to connect keyboard 50 and microphone 56 to transmitter 20 by turning a key in a lock 58 provided for this purpose or by typing the correct combination into a keypad 60. Next, the operator selects the geographic area that he wishes to receive his broadcast by pressing keys on keypad 62 so as to select the frequency of the RF signal generated by transmitter 20. Then, the operator enters into keyboard 50 an appropriate written message and a code corresponding with the level of alert. If desired, the operator can speak into microphone 56 to enter a verbal message into receiver 20. Transmitter 20 transduces the verbal message into an encrypted RF alert signal stream including any written messages and alert codes that are, finally, broadcast by transmitter 20 at a desired frequency.

The code corresponding with the level of alert will vary from time to time as conditions dictate. For example, the Office of Homeland Security has developed a scheme tied to five colors: green, blue, yellow, orange, and red that are supposed to convey an impression of the immediate likelihood of an act of terror. It is anticipated that each of these colors would be represented by a unique sequence of numbers or code that, when input into transmitter 20 through keyboard 50 and broadcast by transmitter 20, would cause correspondingly colored LEDs as at 64 and 66 on transmitter 20 and desktop receiver 24 to be illuminated. All other broadcasts would include a code that would cause white LEDs 68 and 70 on transmitter 20 and desktop receiver 24 to glow.

Mobile transceiver 28 is employed in the event that transmitter 20 becomes inoperative through act of terror or when it is desired to extend the range of system 10. As shown schematically, transceiver 28 is carried by a land vehicle 72 for movement near tower 30. Transceiver 28 is connected to a keyboard 74 and computer processor 76 for entering written messages for broadcast to desktop receivers 24 and pagers 26. A monitor 78 is associated with processor 76 for viewing the writings during entry. Additionally, a microphone 80 is connected to transceiver 28. To ensure that the entry of written and verbal messages into transceiver 28 is authorized, transceiver 28 has a lockout circuit like that in transmitter 20.

Transceiver 28 is capable of receiving communication signals 14 from transmitters 12 and other sources. Incoming signals may be diverted to processor 76 for processing and subsequent displaying on monitor 78. A sound transducer 80 may be provided for generating audible messages.

Use of transceiver 28 is substantially identical to that of transmitter 20. First, an operator closes the lockout circuit to connect processor 76, keyboard 74 and microphone 82 to transceiver 28. Next, the operator selects the frequency of the RF alert signal produced by transceiver 20 by manipulating keypad 84. Then, the operator enters into keyboard 74 any writing and codes corresponding to the level of alert. If desired, the operator speaks into microphone 82 to broadcast a verbal message. Transceiver 28 transduces the verbal message into an encrypted RF alert signal 86 including any written messages and alert codes for broadcast at the selected frequency.

If desktop receiver 24 is tuned to the right frequency and is provided with correct decryption codes, then it will receive alert signal 22 or 86 from either transmitter 20 or transceiver 28. In response, receiver 24 decrypts alert signal 22 or 86 and energizes both an audible alarm 88 and one of colored LEDs 66 and 70 connected thereto. The decrypted alert signal 22 or 86 may also yield a verbal message that is transduced to audible sound by speaker 90. An LCD display 92, connected to receiver 24, displays any written message associated with alert signal 22 or 86. A reset button 94 on receiver 24 permits a user to deenergize illuminated LED 66 or 70, clear LCD display 92, and place receiver 24 in a "stand-by" mode waiting for the next alert signal 22 or 86.

LCD display 92 will exhibit written messages that generally correspond to the different levels of threats issued by the Office of Homeland Security. Display 92 may exhibit the word "low" for a green alert, "guarded" for blue, "elevated" for yellow, "high" for orange, and "severe" for red to correspond with each level of threat. Of course, the exact content of the written message will be determined by inputs made with keyboard 50 or 74.

Receiver 24 may be adjusted using conventional switches or other means (not shown). For example, receiver 24 can, and will, be made to receive only RF alert signals at a frequency specified for a given geographic area. Also, the decryption codes required to energize LEDs 66 and 70 and to obtain the contents of a written or verbal massage can be varied from time to time and place to place to guarantee security of the alert signals. These adjustments are preferably made at the time that receiver 24 is manufactured or distributed, but could be accomplished by a user. Of course, receiver 24 may be made to receive RF weather bulletins directly from NOAA or to receive signals from an alternative source.

A portable pocket pager 26 operates much like receiver 24 to receive an RF alert signal 22 or 86 from either transmitter 20 or transceiver 28 and notify a user. Provided that pager 26 is correctly tuned and provided with correct decryption codes, then it will receive alert signal 22 or 86. On receipt, pager 26 decrypts alert signal 22 and 86 and energizes an audible alarm 96 and an LED 98 connected thereto. The decrypted alert signal may also yield an audible message transduced by a speaker 100. An LCD display 102, also connected to pager 26, displays any written message associated with alert signal 22 or 86. A reset button 104 on pager 26 permits LED 98 and LCD display 102 to be deenergized to wait for the next alert signal 22 or 86. Like receiver, pager 26 may be adjusted to receive only alert signals 22 and 86 at a frequency specified for a set geographic area and to decrypt only specified alert signals.

From the foregoing, it should be appreciated that use of system 10 is straightforward. Only authorized personnel can provide alert signals 22 and 86 to receivers 24 and pagers 26 in affected areas. Since pagers 26 can be carried virtually anywhere, it is possible for a user to never miss a broadcast warning important to his health or welfare.

While the invention has been described with a high degree of particularity, it will be appreciated by those skilled in the art that modifications may be made thereto. For example, the number and location of transmitters 12 and 20, transceivers 28, sensors 16, receivers 18 and 24, and pagers can all be varied to suit local conditions of operation of system 10. Therefore, it is to be understood that the present invention is not limited to the sole embodiment described above, but encompasses any and all embodiments within the scope of the following claims.

I claim:

1. An emergency warning system, comprising:

a sensor for detecting an environmental condition;

a first transmitter being connected to said sensor for broadcasting a communication signal carrying information indicative of said environmental condition;

a first receiver for receiving said communication signal from said first transmitter;

a first computer processor having a memory within which is stored a map of the area surrounding said sensor;

a monitor connected to said first computer processor for displaying said map and information indicative of said environmental condition;

a second transmitter being connected to said first receiver for broadcasting a first alert signal carrying said information indicative of said environmental condition;

a keyboard connected to said second transmitter for entering a message for addition to said first alert signal; and, a second receiver for receiving said first alert signal from said second transmitter, said second receiver having a first indicator for exhibiting said information indicative of said environmental condition and a second indicator for exhibiting said message.

2. The emergency warning system according to claim 1 wherein said first indicator is an LED and said second indicator is an LCD display.

3. The emergency warning system according to claim 1 wherein said first indicator is an array of multi-colored LEDs, each being capable of selective illumination to show a different environmental condition.

4. The emergency warning system according to claim 1 wherein said first indicator is a speaker for transducing an audible signal.

5. The emergency warning system according to claim 1 further comprising a portable pocket pager for receiving said alert signal from said second transmitter and having a third indicator for exhibiting said information indicative of said environmental condition.

6. The emergency warning system according to claim 5 wherein said third indicator is an LED.

7. The emergency warning system according to claim 5 wherein said third indicator is a speaker for transducing an audible signal.

8. The emergency warning system according to claim 1 further comprising a vehicle-mounted, mobile transceiver for receiving said communication signal and broadcasting a broadcasting a second alert signal carrying said information indicative of said environmental condition, and said second receiver being capable of receiving said second alert signal and energizing said first indicator to exhibit said information indicative of said environmental condition.

9. An emergency warning system, comprising;

a sensor for detecting an environmental condition;

a first transmitter being connected to said sensor for broadcasting a communication signal carrying information indicative of said environmental condition;

a first receiver for receiving said communication signal from said first transmitter;

means being connected to said first receiver for simultaneously displaying a map showing the location of said first transmitter and said information indicative of said environmental condition;

a second transmitter being connected to said first receiver for broadcasting a first alert signal carrying said information indicative of said environmental condition;

means being connected to said second transmitter for entering a message for encoding into said first alert signal; and, a second receiver for receiving said first alert signal from said second transmitter, said second receiver having a first indicator for exhibiting said information indicative of said environmental condition and a second indicator for exhibiting said message.

10. The warning system according to claim 9 further comprising a vehicle-mounted, mobile transceiver for receiving said communication signal and broadcasting a second alert signal carrying said information indicative of said environmental condition, and said second receiver being capable of receiving said second alert signal and energizing said first and second indicators.

11. An emergency warning system, comprising:

a sensor for detecting an environmental condition;

a first transmitter being connected to said sensor for broadcasting a communication signal carrying information indicative of said environmental condition;

first receiver for receiving said communication signal from said first transmitter;

means being connected to said first receiver for simultaneously displaying a map showing the location of said first transmitter and said information indicative of said environmental condition;

a second transmitter being connected to said first receiver for broadcasting a first alert signal carrying said information indicative of said environmental condition;

means being connected to said second transmitter for entering a message for encoding into said first alert signal;

a vehicle-mounted, mobile transceiver for receiving said communication signal and broadcasting a second alert signal carrying said information indicative of said environmental condition, and said second receiver being capable of receiving said second alert signal and energizing said first and second indicators a second receiver for receiving said first and second alert signals, said second receiver having a first indicator for exhibiting said information indicative of said environmental condition and a second indicator for exhibiting said message; and, a portable pocket pager for receiving said first and second alert signals and having a third indicator for exhibiting said information indicative of said environmental condition.

* * * * *